US005092520A

United States Patent [19]

Lestage

[11] Patent Number: 5,092,520

[45] Date of Patent: Mar. 3, 1992

[54] HOUSEHOLD DEHUMIDIFIER

[75] Inventor: Marc R. Lestage, Shediac, Canada

[73] Assignee: Air-Tech Equipment Ltd., Moncton

[21] Appl. No.: 619,962

[22] Filed: Nov. 30, 1990

[51] Int. Cl.[5] ..... F24F 7/007; B01F 3/02

[52] U.S. Cl. ..... 236/44 A; 454/343; 454/354

[58] Field of Search ..... 236/44 A, 44 R, 46.3; 98/42.04, 42.02, 33.1

[56] References Cited

U.S. PATENT DOCUMENTS

| | | | |
|---|---|---|---|
| 2,433,544 | 12/1947 | Blake et al. | 98/43 |
| 2,615,383 | 10/1952 | Jenn | 98/33 |
| 2,828,682 | 4/1958 | Marker | 98/43 |
| 2,831,638 | 4/1958 | Fulk | 236/49.3 |
| 3,173,353 | 3/1965 | Watkins | 236/49.3 X |
| 3,332,620 | 7/1967 | Streed | 236/44 A |
| 3,459,115 | 8/1969 | Gutermuth | 98/43 |
| 4,251,026 | 2/1981 | Siegel et al. | 236/49 |
| 4,515,070 | 5/1985 | Bobjer et al. | 98/42.07 |
| 4,843,786 | 7/1989 | Walkinshaw et al. | 52/169.5 |

FOREIGN PATENT DOCUMENTS

| | | | |
|---|---|---|---|
| 429361 | 8/1945 | Canada . | |
| 1097531 | 3/1981 | Canada . | |
| 1099138 | 4/1981 | Canada . | |
| 1186999 | 2/1965 | Fed. Rep. of Germany | 98/42.04 |
| 0207933 | 8/1988 | Japan | 98/42.04 |

*Primary Examiner*—William E. Wayner
*Attorney, Agent, or Firm*—Leonard Bloom

[57] ABSTRACT

The invention relates to an air extraction apparatus for conditioning air in an enclosed space wherein the air in said enclosed space is stratified due to a temperature gradient between a ceiling and floor of the enclosed space. The apparatus includes a conduit having an inlet end and an outlet end, the conduit adapted to be arranged and installed with its outlet end in communication with an opening in a wall of the enclosure and its inlet end in proximity to the floor when in use. A fan means is located in the conduit to effect movement of air from the floor level of the enclosure through the inlet end to and outwardly of the outlet end. A control means is attached to the conduit and is associated with the fan means to selectively connect the fan means to a source of power, the control means being responsive to a selected condition e.g. relative humidity of the air in the enclosure.

8 Claims, 3 Drawing Sheets

HOUSEHOLD DEHUMIDIFIER

This invention relates to a dehumidifying apparatus specifically for use in a closed space such as a basement.

BACKGROUND OF THE INVENTION

It has often been a complaint of most home owners that basements below ground level tend to have a musty odour. Furthermore it has been found that moisture accumulates in a basement, which contributes to this musty damp odour. Moisture can be removed from the air by cooling the air below its dew-point, which results in the condensation of the vapor and its subsequent removal as a liquid. One of the techniques that dehumidifier devices use to accomplish this is by use of a surface cooling technique in which air is passed over tubes cooled by a refrigerant flowing through them to cool the air below its dew-point and thereby cause the water vapor to condense out. As can be appreciated these processes require the expenditure of large amounts of energy in order to reach an acceptable level of relative humidity in a room. It is this cost factor that has been a deterrent to most home owners installing effective dehumidifiers in their basement.

SUMMARY OF THE INVENTION

It is an object of this invention to provide a relatively inexpensive system for removing moist damp air from a basement or underground enclosed area, such as a crawl space below a dwelling, wherein the air within this enclosed space is stratified due to a temperature gradient between the floor and ceiling in the enclosed space.

It is another object of this invention to provide a dehumidifier that is relatively inexpensive to operate and install.

The invention in one aspect relates to an air extraction apparatus for conditioning air in an enclosed space wherein the air in said enclosed space is stratified due to a temperature gradient between a ceiling and floor of said enclosed space. The apparatus includes a conduit having an inlet end and an outlet end, said conduit adapted to be arranged and installed with its outlet end in communication with an opening in a wall of the enclosure and its inlet end in proximity to said floor when in use. A fan means is located in said conduit to effect movement of air from said floor level of said enclosure through said inlet end to and outwardly of said outlet end. A control means is attached to said conduit and is associated with said fan means to selectively connect said fan means to a source of power, said control means being responsive to a selected condition e.g. relative humidity of said air in said enclosure.

BRIEF DESCRIPTION OF THE DRAWINGS

A better understanding of the invention will be obtained by reference to the detailed description below in connection with the following drawings in which.

DETAILED DESCRIPTION OF THE PREFERRED EMBODIMENT

Figure 1:
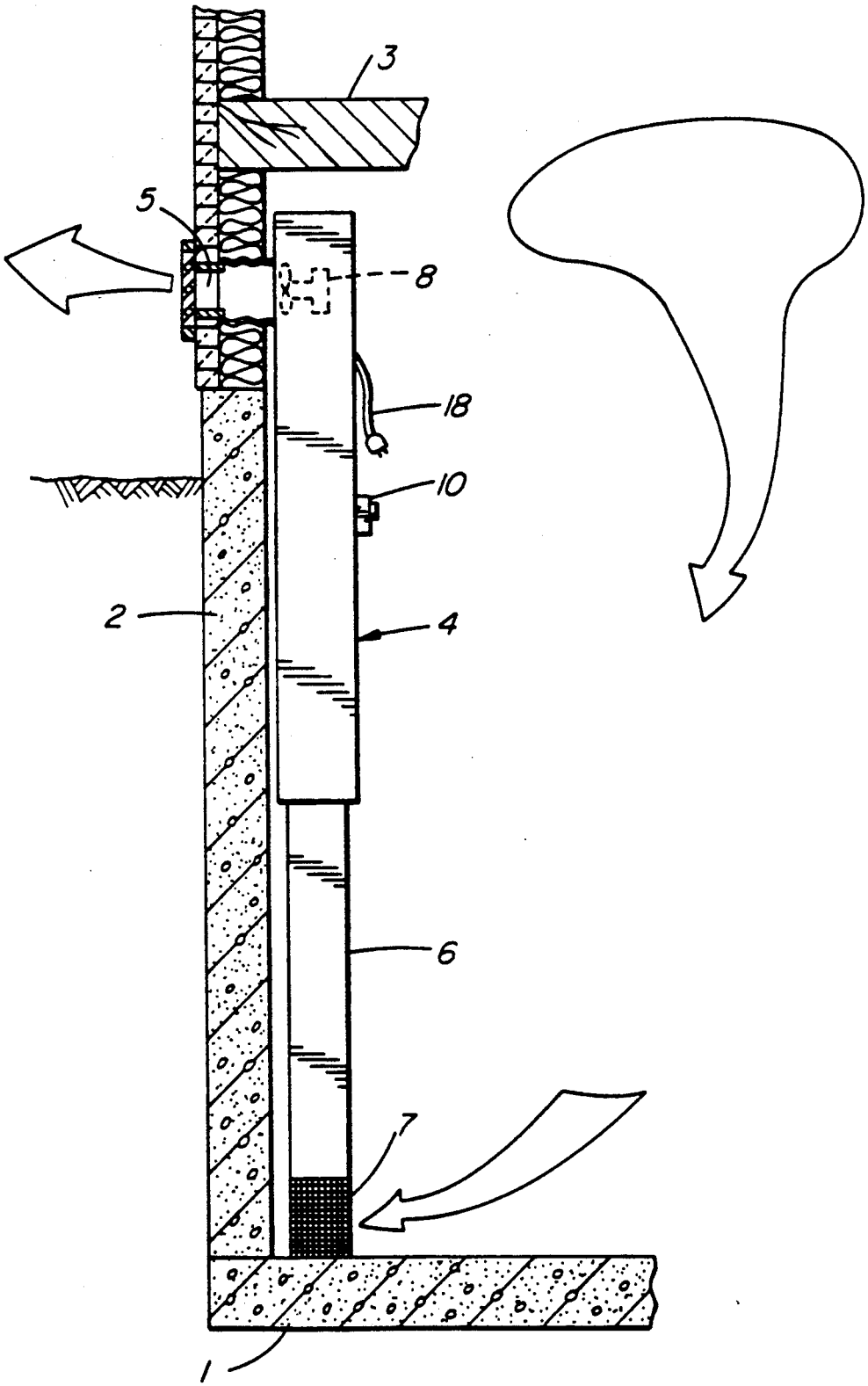
FIG. 1 is a side elevation view of one embodiment of the invention.

Referring to FIG. 1, a cross-sectional view of part of a basement wall is shown having a floor 1, a side wall 2 and a ceiling 3. The side wall 2 separates the interior basement from the outside environment The dehumidifying device as shown generally by numeral 4 is shown installed along the side wall 2. The dehumidifying device 4 exhausts air through an air outlet opening 5 in the sidewall 2, which opening is connected via a conduit 6 to receive air via an air inlet 7 positioned at the floor level 1 of the enclosure. A fan 8 attached to the inside of the conduit 6 causes air to be sucked through the inlet opening and to be exhausted out of the basement via the outlet opening 5. The air outlet 5 as noted above is in a side wall of the basement, preferably a hole defined by an existing window or any other suitable opening that leads external to the basement. A detailed description of the dehumidifier device will be provided later.

The principle of operation of the dehumidifier will now be explained. In a typical below ground basement, air at the floor level is much cooler than air at the ceiling level of the basement. The air at the roof level is warmer due to conduction through the floor slab of the upper building supported by the basement. Based on well known thermodynamic principles the warm air will be relatively less humid than the cooler air. By removing this cool damp air from the lower portions of the enclosure a circulation is induced in the enclosure, whereby the cool air is sucked out the building and exhausted external to the basement while the warmer relatively dry air is then forced to circulate down to the floor level and thus replace the humid cool air thereby reducing the average relative humidity of the room. A suitably positioned humidity control switch 10 serves to control the humidity in the room by turning off the fan when the humidity reaches an acceptable level in the room.

Figure 2:
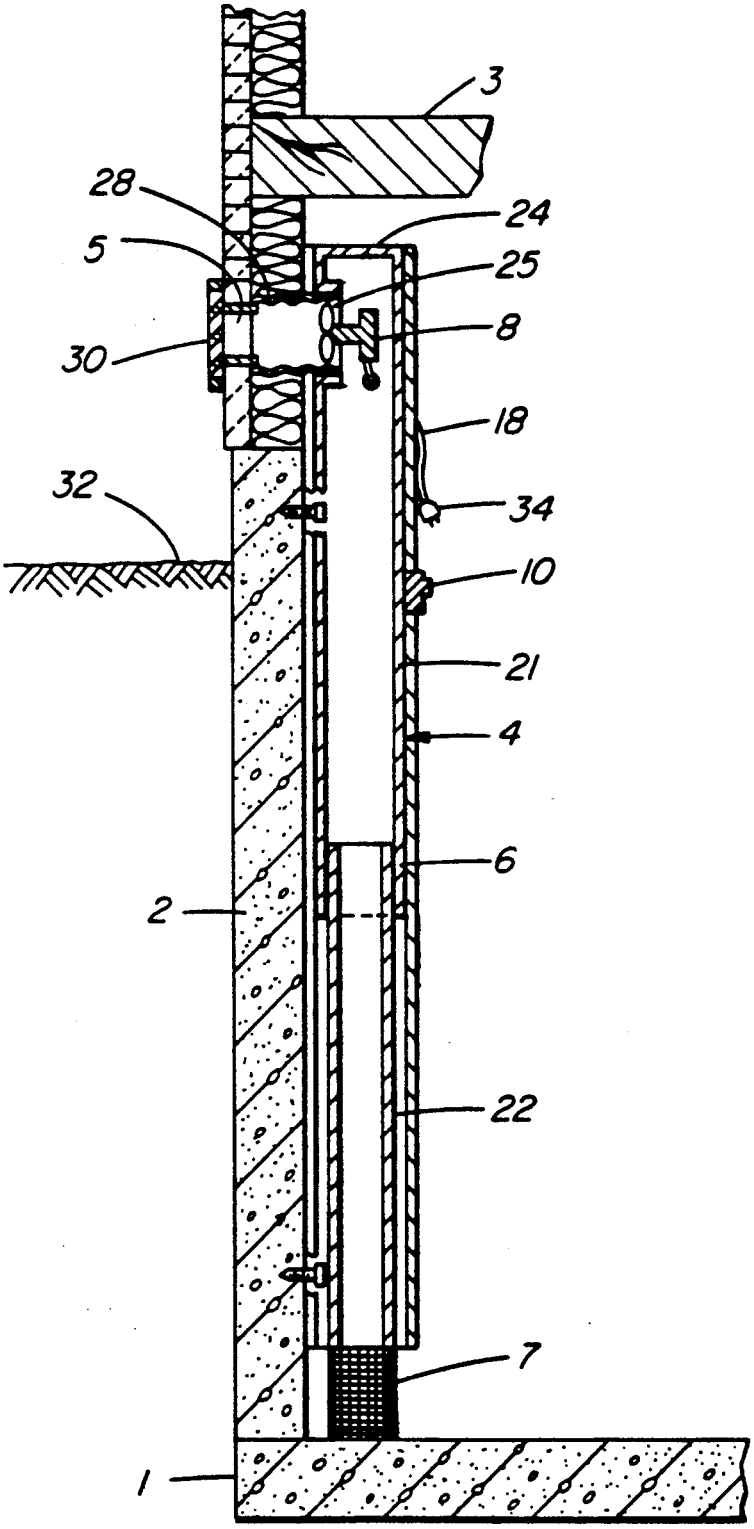
FIG. 2 is a longitudinal section view of the embodiment shown in FIG. 1.

A detailed description of the device will be discussed with reference to the view of the dehumidifier as shown in FIG. 2. The body of the dehumidifier device 4 is made from extruded aluminium tube, of rectangular cross section, which forms the vertical conduit 6. This vertical conduit is divided into an upper and lower section 21 and 22 respectively. The upper section 21 is closed at one end and open at the other end. The lower conduit section 22 is telescopically slidable in the upper conduit 21. As can be seen from FIG. 2 the upper and lower sections 21 and 22 are attached to the vertical side wall 2 of the basement. The telescopically slidable sections allow the height of the dehumidifier to be adjusted to accommodate varying ceiling to floor heights in a basement. A typical length chosen for the lower section is 4 feet and a typical length for the upper section is 5 feet; thus with the units completely extended, the distance between the air inlet and outlet is approximately 9 feet. The lower section conduit 22 as noted above is made of extruded aluminum tubing of rectangular cross section and is open at both ends. One end is inserted into the open end of the upper conduit section 21. The other end of the lower section 22 i.e. the air inlet 7 is enclosed by a screen which prevents undesirable items such as pieces of paper and fluff being sucked up through the conduit 6. The upper conduit section 21 has an outlet opening 25 in its side wall near its upper closed end 24. The position of this opening is chosen to face in the direction of the side wall 2 when the unit is installed in a basement. A flexible conduit 28 is attached to the opening 25 in the upper conduit section 21 and extends through the outlet opening 5 in the side wall of the basement leading outside the basement, preferably above ground level 32, as illustrated in FIG. 2. A suitable outlet screen or louvre 30 prevents entry of small animals and insects into the system.

An AC electric fan 8 connected to operate from a 110 volt electrical supply, is mounted on the inside wall of the upper conduit section 21. It has been found that a 240 cubic feet/minute (CFM) fan is of adequate size to effectively dehumidify an average sized basement The fan 8 is connected to a source of electrical power via an electrical power cord 18 terminated in a plug 34.

A humidity control switch 10, commonly known as a humidistat, serves to adjust the level of humidity within the basement by sensing the humidity in the air at a particular level, in this case, about 1½ to two metres from the floor level and provides an electrical signal which is used to switch off the fan 5 when the humidity reaches a preset level. This humidity level is normally set by a graduated dial on the humidistat 10. The humidity control switch 10 is attached to the upper conduit section 21.

Figure 3:
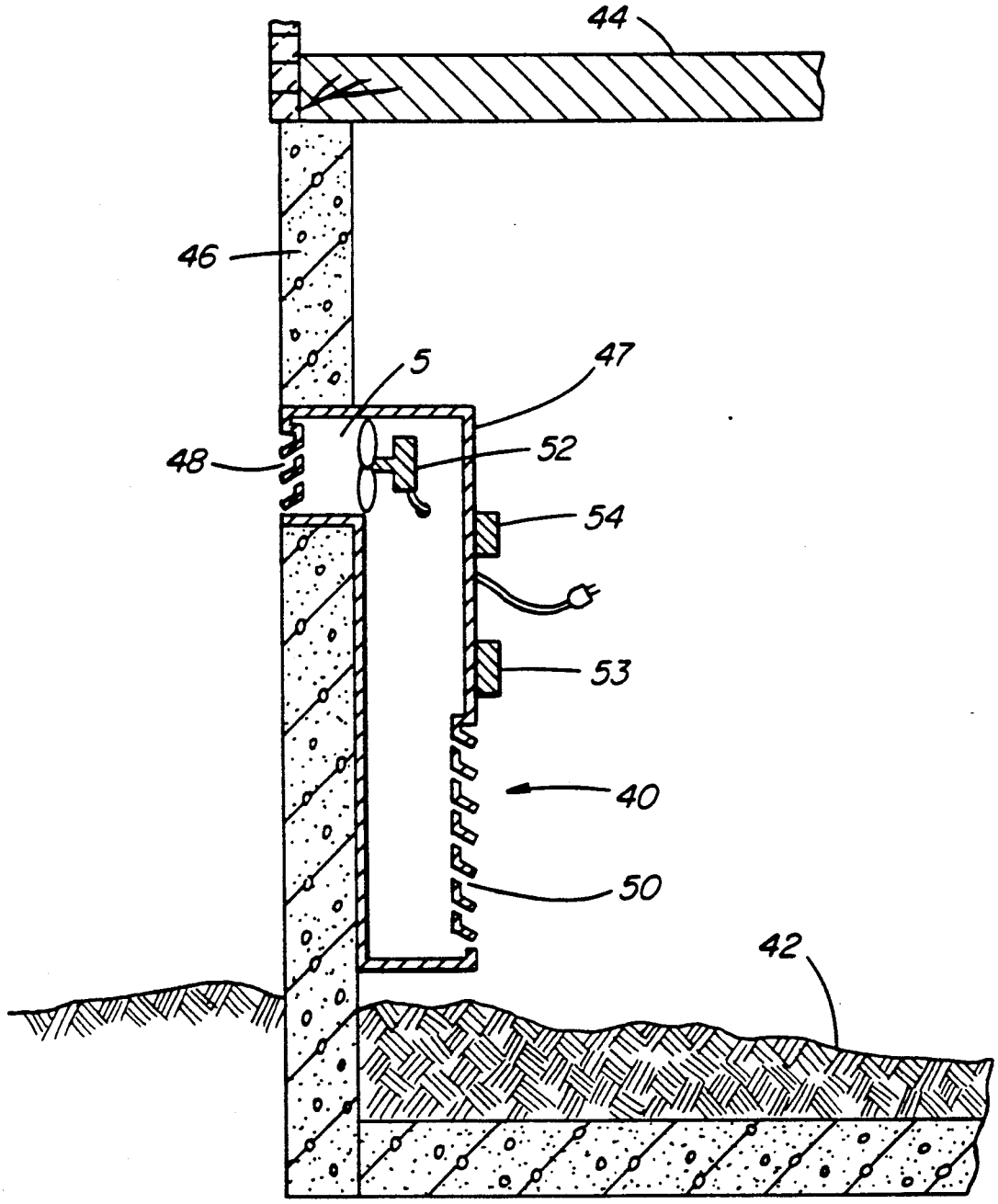
FIG. 3 is a longitudinal section view of a second embodiment of the invention.

It has been found that the principle used by the apparatus as described in FIGS. 1 and 2 to dehumidify a basement, can also be used to dehumidify other enclosed areas, such as crawl spaces below homes. Referring to FIG. 3, a crawl space dehumidifying unit is shown generally by numeral 40. The crawl space is defined as the space between the ground 42 and an elevated floor 44 wherein a side wall 46 extends between the floor 44 and the ground 42. The dehumidifier unit comprises a housing 47 having typical outer dimensions of 24 inches deep, 7 inches wide and a 5 height of about 8 feet which is enclosed at both ends. As can be seen from FIG. 3, the unit is attached to the side wall 46 similarly to the unit described in FIG. 2. The upper end of the housing 47 has an air outlet opening 48 in the side facing the side wall 46, and the lower end of the housing has an air inlet opening 50 on the side opposite the air outlet 48. This arrangement allows the unit to be attached directly against the side wall. An AC electric fan 52 is attached to the inside of the housing adjacent outlet opening 48. The fan is connected to a source of electric power via an electric power cord. Air is sucked out of the crawl space by the fan and exhausted through the outlet opening 48 by the fan. A humidistat 54 and a frost control switch 53 are attached to the outer side wall of the housing 47, and together provide an electrical signal to operate the fan.

The operation of these controls can be explained as follows. The control of the humidity is maintained by adjusting the humidity control switch to the required humidity setting When the humidity level in the crawl space is high, the humidistat will activate the fan motor to draw air away from the crawl space. However if the temperature in this area is below 40° F., any operation of the fan would only serve to reduce the temperature in the crawl space, thus possibly freezing any plumbing system in this space. Hence, the frost control switch 53 prevents the operation of the fan unit below a preset temperature, in this case 40° F.

It will be appreciated that the foregoing embodiments are presented by way of example only and are not intended to limit the scope of the present invention.

The embodiments of the invention in which an exclusive property or privilege is claimed are defined as follows:

1. An air extraction apparatus for conditioning air in an enclosed space wherein the air in said enclosed space is stratified due to a temperature gradient between a ceiling and floor of said enclosed space, said apparatus comprising:

a conduit having an air inlet end and an air outlet end, said conduit adapted to be arranged and installed with its outlet end in communication with an opening in a wall of the enclosure, and its inlet end in proximity to said floor when in use;

a fan means disposed in said conduit to effect movement of air from said floor level of said enclosure through said inlet end to and outwardly of said outlet end;

a control means attachable to said conduit and associated with said fan means, said control means including a humidity control means responsive to the humidity of said air in said enclosure to selectively connect said fan means to a source of power, and a temperature control means for preventing the operation of said humidity control below a preset temperature.

2. A device as defined in claim 1, wherein said conduit has an upper section and lower section, said upper section conduit being closed at one end and open at an opposite end, and said lower section conduit is telescopically movable within said open end of the upper section conduit to accommodate different enclosure heights.

3. A device as defined in claim 2, wherein said upper and lower section conduits are rectangular cross-section tubes.

4. A device as defined in claim 3, wherein said upper section conduit has an air outlet opening in close proximity to said closed end and said lower section conduit has said air inlet opening at one end on a side of said conduit opposite to said air outlet opening.

5. A device as defined in claim 1, wherein said means is a humidistat attachable to the outside of said conduit.

6. A device as defined in claim 1, wherein said temperature control means is a thermostat.

7. An air extraction apparatus for conditioning air in an enclosed space wherein the air in said enclosed space is stratified due to a temperature gradient between a ceiling and floor of said enclosed space, said apparatus comprising:

a conduit having an air inlet end and an air outlet opening at its opposite end, said conduit adapted to be arranged and installed with its outlet end in communication with an opening in the enclosure, and said conduit having an upper section and a lower section, said upper section being closed at one end and open at an opposite end, and said lower section being telescopically movable within said open end of the upper section, said upper and lower section conduits are rectangular cross-section tubes, said upper conduit section has an air outlet opening in close proximity to said closed end and said lower conduit section has said air inlet opening at one end in a wall of said conduit opposite to said air outlet opening;

a fan means in said conduit to effect movement of air from said floor level of said enclosure through said inlet end to and through said outlet end;

a humidistat adapted to be attached to an outside wall of said conduit and electrically connected to said fan means to selectively connect said fan means to a source of power, said humidistat being responsive to a condition of said air in said enclosure whereby to cause the cooler and relatively more humid air to be drawn from adjacent the floor of the enclosed space to reduce the overall relative humidity of the air in the enclosed space; and a temperature control means associated with said humidistat for preventing the operation of the humidistat below a preset temperature.

8. A device as defined in claim 7, wherein said temperature control means is a thermostat.

* * * * *

UNITED STATES PATENT AND TRADEMARK OFFICE

CERTIFICATE OF CORRECTION

PATENT NO. : 5,092,520

DATED : March 3, 1992

INVENTOR(S) : Lestage

It is certified that error appears in the above-indentified patent and that said Letters Patent is hereby corrected as shown below:

In column 3, line 12 after "basement" and before "The", insert therein a period -- . -- ;

In column 3, line 36, delete "5";

In column 3, line 56 after "setting" and before "When", insert therein a period -- . --;

Col. 4, line 53 after "having" and before "an", insert --its inlet end in proximity to said floor when in use, said conduit having--.

Signed and Sealed this

Thirty-first Day of August, 1993

Bruce Lehman

*Attest:*

BRUCE LEHMAN

*Attesting Officer*

*Commissioner of Patents and Trademarks*